US005373689A

United States Patent [19]

Maeser et al.

[11] Patent Number: 5,373,689

[45] Date of Patent: Dec. 20, 1994

[54] TWO-SIDED RING-SPINNING MACHINE WITH BOBBIN-CHANGING APPARATUS

[75] Inventors: Martin Maeser, Albershausen; Dieter Vetter; Stefan Krawietz, both of Ebersbach, all of Germany

[73] Assignee: Zinser Textilmaschinen GmbH, Ebersbach/Fils, Germany

[21] Appl. No.: 95,056

[22] Filed: Jul. 20, 1993

[30] Foreign Application Priority Data

Jul. 24, 1992 [DE] Germany ..... 4224436

[51] Int. Cl.[5] ..... D01H 9/00; D01H 9/04

[52] U.S. Cl. ..... 57/281; 281/90; 281/266

[58] Field of Search ..... 57/275, 90, 281, 266

[56] References Cited

U.S. PATENT DOCUMENTS

| | | | |
|---|---|---|---|
| 3,550,368 | 12/1970 | Marenco | 57/52 |
| 4,723,405 | 2/1988 | Shinkai et al. | 57/266 |
| 4,817,373 | 4/1989 | Gualchierani | 57/281 |
| 5,016,433 | 5/1991 | Putz et al. | 57/264 |
| 5,125,224 | 6/1992 | Klaus | 57/281 X |

FOREIGN PATENT DOCUMENTS

| | | | |
|---|---|---|---|
| 0445374 | 11/1990 | European Pat. Off. . | |
| 2045263 | 4/1971 | Germany . | |
| 2416725 | 11/1974 | Germany . | |
| 1785217 | 8/1976 | Germany . | |
| 4106542 | 9/1992 | Germany | 57/266 |
| 2155510 | 9/1985 | United Kingdom | 57/281 |

*Primary Examiner*—Daniel P. Stodola
*Assistant Examiner*—William Stryjewski
*Attorney, Agent, or Firm*—Herbert Dubno; Andrew Wilford

[57] ABSTRACT

A two-sided ring-spinning machine has a frame and a pair of parallel spindle banks each holding a respective row of bobbins. A bobbin-changing apparatus has respective gripper beams engageable with the bobbins of the spindle banks, respective scissor linkages pivoted on the frame and on the gripper beams extendable for raising the respective beams and collapsible for lowering the respective beams, and a single force-transmitting element connected to both of the linkages and displaceable longitudinally in one direction for extending the linkages and in the opposite direction for collapsing the linkages. A single drive is connected between the frame and the force-transmitting element for simultaneously vertically displacing both beams.

8 Claims, 1 Drawing Sheet

TWO-SIDED RING-SPINNING MACHINE WITH BOBBIN-CHANGING APPARATUS

FIELD OF THE INVENTION

The present invention relates to a ring-spinning machine. More particularly this invention concerns a two-sided ring-spinning machine with an automatic bobbin-changing apparatus.

BACKGROUND OF THE INVENTION

A two-sided ring-spinning machine with a bobbin-changing apparatus for simultaneously changing full bobbins for empty ones on both sides of the machine has a pair of gripper beams each moved by a respective push/pull member via a respective scissor linkage to grab the full and empty bobbins on each side of the machine.

In order to be able to move this gripper beam in and out and up and down as is necessary for changing the bobbins, each beam is held on a scissor linkage which is pivoted about a shaft in the lower region of the spinning machine or is mounted in a traveling slide. The drive for up-and-down movement of the gripper beam is effected by longitudinal movement of the shaft as described in European patent publication 445 375 of W. Klaus or a pull rod mounted in the slide as described in German 20 45 263 or by pulling members as described in German 17 85 217 on the scissor linkage. Electric motors and shaft drives as described in European patent publication 445 374 or fluid-powered drive elements as described in above-mentioned German 20 45 263 are used to power the push/pull element.

Even when, as is the rule, it is necessary to change full bobbins with empty ones on both sides of a two-sided spinning machine and the gripper beams are moved synchronously along the two sides of the machine, a separate element (spindle drive, piston/cylinder unit) producing the push or pull movement is provided for each of the gripper beams as described in German 21 58 657. The ring-spinning machines of the applicant are delivered with the drives of the two drive shafts powered by a single electric motor, but have for each machine side a separate push-or pull-producing element in the form of a threaded spindle with a nut.

OBJECTS OF THE INVENTION

It is therefore an object of the present invention to provide an improved two-sided ring-spinning machine with automatic bobbin changer.

Another object is the provision of such an improved two-sided ring-spinning machine with automatic bobbin changer which overcomes the above-given disadvantages, that is which is substantially simpler in construction.

SUMMARY OF THE INVENTION

The instant invention is used in a two-sided ring-spinning machine having a frame and a pair of parallel spindle banks each holding a respective row of bobbins. It is a bobbin-changing apparatus having respective gripper beams engageable with the bobbins of the spindle banks, respective scissor linkages pivoted on the frame and on the gripper beams extendable for raising the respective beams and collapsible for lowering the respective beams, and a single force-transmitting element connected to both of the linkages and displaceable longitudinally in one direction for extending the linkages and in the opposite direction for collapsing the linkages. A single drive is connected between the frame and the force-transmitting element for simultaneously vertically displacing both beams.

Thus with this system a single drive is used for both sides, without the problems of the prior-art systems. While it is known from above cited German 21 58 657 to drive the scissor linkages by a rotatable shaft provided with a screwthread for each scissor linkage, these shafts rotate but do not move longitudinally, so no problematic moments are created when they are differently loaded. The two shafts can for example be joined together by means of a chain or belt drive and can be driven by a common motor. This solution has the disadvantage that the many screwthreads are very expensive and the load capacity must be very large as a result of the high frictional loses in the many screwthreads.

According to the invention the force-transmitting element is pivotally coupled to the drive means and to both of the scissor linkages. Linkage guides connected to lower ends of the scissor linkages guide same longitudinally on the frame and prevent substantially all transverse movement of the lower ends on the frame. Similarly element guides connected to the force-transmitting element guide same longitudinally on the frame.

The element according to this invention is between the linkages and each of the linkages includes a pair of arms both of which have lower ends, one of which has an upper end pivoted on the respective beam, and the other of which has an upper end pivoted on the respective one arm below the respective beam, and a longitudinally extending member on which one of the lower ends is pivoted but fixed against longitudinal movement and on which the other lower end is pivoted and along which the other lower end is slidable. The element has arms pivoted on and longitudinally fixed to the members. More particularly the element is pivoted on the members at respective joints permitting limited relative transverse movement of the members and element.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
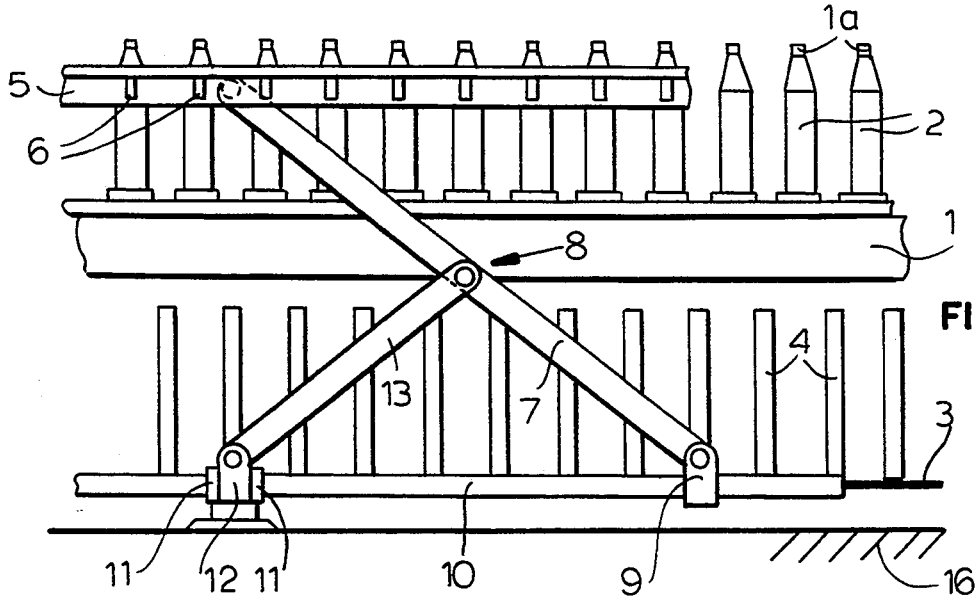
FIG. 1 is a partly diagrammatic and sectional side view of a single scissor-linkage arrangement in a ring-spinning machine.

As seen in FIG. 1 a ring-spinning machine has a spindle bank 1 provided with rows of spindles 1*a* carrying respective finished cops 2. Empty sleeves 4 ready for mounting on the spindles 1*a* are on a transport apparatus 3. Grippers 6 for grasping the cops 2 or the sleeves 4 are arranged in the apparatus 3 on a gripper beam 5 that is pivoted on a long arm 7 of a scissor linkage 8 which is pivoted at its other end in a support 9. The support 9 is fixed to a horizontal push/pull rod 10 which is slidable and pivotal about its horizontal center axis in slide guides 11 fixed on the machine frame 16. A further support 12 slidable on the rod 10 is guided between the slide guides 11 on the push/pull rod 10 and pivotally supports a short arm 13 of the scissor linkage 8. The other end of the short arm 13 is pivoted in the middle of the long arm 7. The pivot axes between the two arms 7 and 8 and between the arms 7 and 8 and the respective supports 9 and 11 are all horizontal, parallel, and perpendicular to a plane including the axis of the rod 10 and on which the arms 7 and 8 lie.

The scissor linkage 8 is shown in an intermediate position in FIG. 1. Turning of the push/pull rod 10 swings the entire scissor linkage 8 and with it the gripper beam 5 in and out perpendicular to the longitudinal extension of the ring-spinning machine and to the plane of the view of FIG. 1. Longitudinal sliding of the push-/bull beam 10 extends and retracts the scissor linkage 8 and thus moves the gripper beam 5 up and down in a vertical direction perpendicular to the longitudinal extension of the ring-spinning machine.

The method of changing full cops against empty sleeves is known and is therefore not more closely described here.

Figure 2:
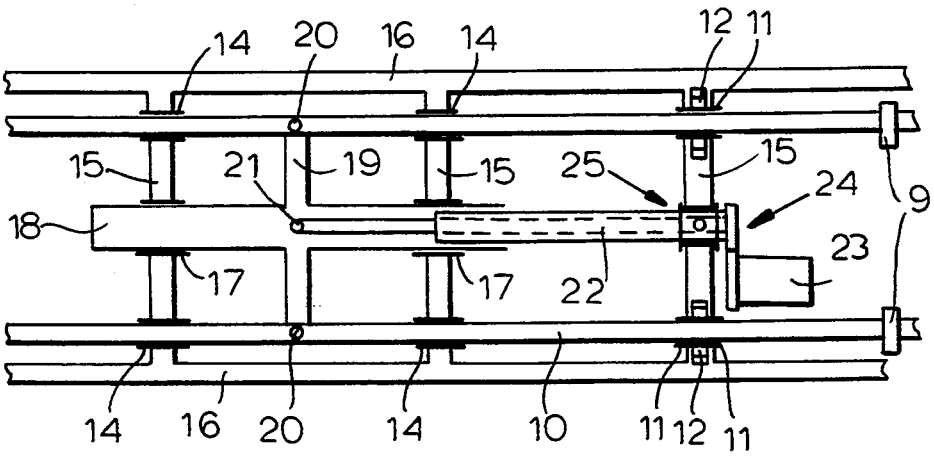
FIG. 2 is a partly diagrammatic top view of a first embodiment of the invention.

FIG. 2 shows the guiding of the two push/pull members 10 in the slide guides 11 and in further similar slide guides 14 fixed in the machine frame 16. These slide guides are arranged on traverses 15 of the machine frame 16 which for example are arranged as intermediate struts or cross members. Further slide guides 17 slidably support a slide 18 having crosswise arms 19 on which the push/pull members 10 are pivoted at 20. In addition the slide 18 pivotally supports at 21 the push-/pull element 22 here shown as a spindle drive and driven by a motor 23 via a transmission 24. A threaded sleeve of the spindle drive 22 is pivoted in the traverse 15 in a bearing 25 so as to be axially nonmovable. The pivots 20 and 21 are so articulated that they cannot bind and transmit transverse forces, that is they permit the slide 18 to cant somewhat between the members 10 without jamming.

In order to move the gripper beam 5 up and down the threaded sleeve of the spindle drive 22 is rotated by the motor 23 and the slide 18 is shifted by the threaded spindle connected to point 21. The arms 19 then entrain the push/pull members 10 of both machine sides for synchronous movement. Transverse forces created by differential loading of the push/pull members 10 of the two machine sides are thus taken up by the guides 17 of the slide 18 so that they are not transmitted transversely from one of the push/pull members 10 to the other or to the spindle drive 22 of the slide 18.

On the right-hand traverse 15 of FIG. 1 between the split slide guides 11 are the supports 12 on which the lower ends of the short arms 13 are pivoted and on each of which is pivoted the support 9 of the push/pull rod 10, on which support the lower end of the long arm 7 of the scissor linkage 8 is pivoted.

Figure 3:
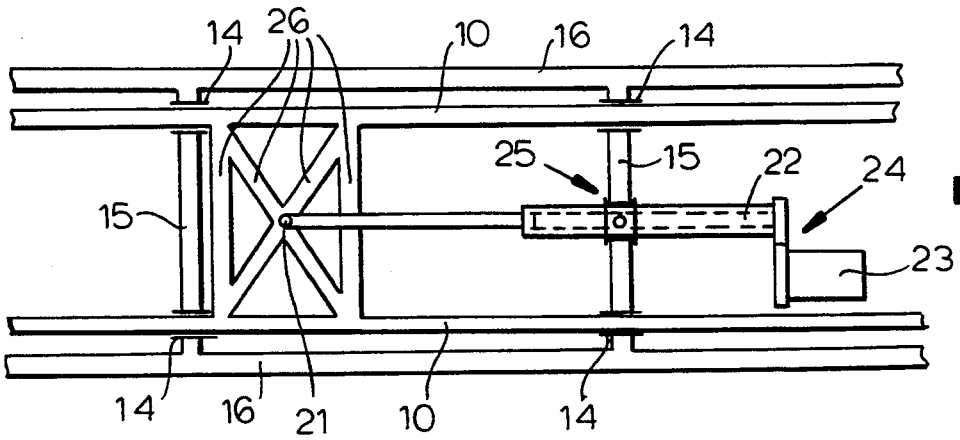
FIG. 3 is a view like FIG. 2 of a second embodiment of the invention.

In the embodiment of FIG. 3 the push/pull members 10 of the two machine sides are connected with each other rigidly by transverse struts 26 in the plane of the push/pull forces effective on them. Preferably the push-/pull element 22 is connected at the intersection of the transverse struts 26 to the push/pull member. The slide guides 14 of the push/pull member and even the push-/pull members themselves can be reinforced in a region which extends from the transverse struts 26 to the next guide slide 14 in order to be able to withstand the transverse forces effective in this region and transmit them to the machine frame 16.

The push or pull force effective from the push/pull element 22 on the push/pull rod 10 creates counter-forces in the slide guides 11 along the machine, which forces must be transmitted by the machine frame 16 to the connection point of the push/pull element 22. When as suggested by the invention the push/pull element 22 is arranged generally in the longitudinal middle of the machine, these forces transmitted through the machine frame 16 are only added to each other over half of the length of the machine to about half of the total force. Thus the machine frame is substantially relieved and is subjected to less deformation, or can be built lighter and more inexpensively.

We claim:

1. In a two-sided ring-spinning machine having a frame and a pair of parallel spindle banks each holding a respective row of bobbins, a bobbin-changing apparatus comprising:

respective gripper beams engageable with the bobbins of the spindle banks;

respective scissor linkages pivoted on the frame and on the gripper beams extendable for raising the respective beams and collapsible for lowering the respective beams;

a single force-transmitting element connected to both of the linkages for joint longitudinal displacement therewith and displaceable longitudinally in one direction for extending the linkages and longitudinally in the opposite direction for collapsing the linkages; and a single longitudinally extensible and contractile drive means connected between the frame and the force-transmitting element for simultaneously vertically displacing both beams.

2. The bobbin-changing apparatus defined in claim 1 further comprising:

linkage guide means connected to lower ends of the scissor linkages for guiding same longitudinally on the frame and preventing substantially all movement of the lower ends on the frame in directions transverse to the frame.

3. The bobbin-changing apparatus defined in claim 2, further comprising:

element guide means connected to the force-transmitting element for guiding same longitudinally on the frame.

4. The bobbin-changing apparatus defined in claim 3, wherein the force-transmitting element is between the linkages.

5. The bobbin-changing apparatus defined in claim 1 wherein each of the linkages includes:

a pair of arms both of which have lower ends, one of which has an upper end pivoted on the respective beam, and the other of which has an upper end pivoted on the respective one arm below the respective beam, and a longitudinally extending member on which one of the lower ends is pivoted but which is fixed against longitudinal movement and on which the other lower end is pivoted and along which the other lower end is slidable.

6. The bobbin-changing apparatus defined in claim 5 wherein the force-transmitting element lies between the linkages and has arms pivoted on and longitudinally fixed to the members.

7. The bobbin-changing apparatus defined in claim 6, wherein the force-transmitting element is pivoted on the members at respective joints permitting limited relative movement of the members and force-transmitting element transversely of the frame.

8. In a two-sided ring-spinning machine having a frame and a pair of parallel spindle banks each holding a respective row of bobbins, a bobbin-changing apparatus comprising:

respective gripper beams engageable with the bobbins of the spindle banks;

respective scissor linkages pivoted on the frame and on the gripper beams, extendable for raising the respective beams, and collapsible for lowering the respective beams;

a single force-transmitting element connected to both of the linkages and displaceable longitudinally in one direction for extending the linkages and in the opposite direction for collapsing the linkages; and a single longitudinally extending and longitudinally extensible and contractile drive means having one end pivoted on the frame and an opposite end pivoted on the force-transmitting element for simultaneously vertically displacing both beams.

* * * * *